United States Patent [19]

Stephen

[11] 4,403,806

[45] Sep. 13, 1983

[54] GOLF SEAT

[76] Inventor: Alex Stephen, 2130 El Camino, Turlock, Calif. 95380

[21] Appl. No.: 74,873

[22] Filed: Dec. 10, 1979

Related U.S. Application Data

[63] Continuation-in-part of Ser. No. 2,898, Jan. 12, 1979, abandoned.

[51] Int. Cl.[3] ..... A47C 7/62

[52] U.S. Cl. ..... 297/217; 108/44; 280/DIG. 6

[58] Field of Search ..... 108/44; 280/DIG. 6; 248/148; 297/217

[56] References Cited

U.S. PATENT DOCUMENTS

| | | | |
|---|---|---|---|
| 2,568,628 | 9/1951 | Herring | 108/44 |
| 2,610,072 | 9/1952 | Head | 280/DIG. 6 |
| 2,611,570 | 9/1952 | Kroll | 248/148 |
| 2,837,304 | 6/1958 | Goss, Sr. | 248/148 X |
| 3,017,152 | 1/1962 | Alpaugh | 248/148 |
| 3,633,519 | 1/1972 | Nichol | 108/44 |
| 4,010,696 | 3/1977 | Priesman | 108/44 |

*Primary Examiner*—James T. McCall

[57] ABSTRACT

A portable seat has pairs of rigid projections depending from the underside thereof with facing cut-out portions of each pair defining means for removably mounting the seat on golf cart wheels of various sizes.

4 Claims, 5 Drawing Figures

GOLF SEAT

This is a continuation-in-part of my co-pending U.S. patent application Ser. No. 002,898 filed Jan. 12, 1979 for "Golf Cart Seat", now abandoned.

BACKGROUND OF INVENTION

Two and three-wheeled carts are commonly employed by golfers to hold a golf bag containing golf clubs, balls, and the like, for wheeling the bag and contents about a golf course. It is known from my above-noted patent application to provide a small portable seat adapted to fit upon a tire of such a cart as a resting place for a golfer during waiting periods in play of the game. Such a seat is advantageous in that it may be readily stored in a pocket of a golf bag when not in use and may easily be used merely by placing it on a cart tire at any desired location of the cart. The golfer may then relax in the shade, if desired, while awaiting his or her turn at play.

The present invention provides an improved seat structure for mounting on golf carts.

SUMMARY OF INVENTION

The seat of the present invention has a generally planar top portion which may be padded on top, and a plurality of pairs of projections on the underside for fitting tightly onto the top of tires on golf carts. Two pairs of projections are provided to engage any one tire size for good gripping of the tire to provide a steady seat.

The projections of each pair thereof are formed as mirror images of each other and have inclined, facing cut-out portions of different separations from a center line of the seat to accommodate gripping of tires of different sizes. An outer two pairs of projections are adapted to fit two larger tire sizes and an inner two pairs of projections are adapted to fit two smaller tire sizes so that the seat will fit the tires of substantially all carts.

Different carts have wheels of different diameters and different tire widths. The tire widths increase as the wheel diameter increases and the present invention may typically fit the widths of one inch, one and one-quarter inch, one and one-half inch and one and three-quarter inch. The cut-out portions define inclined surfaces for engaging a tire periphery and vertical facing shoulders for engaging the sides of a tire for firm gripping of a tire.

DESCRIPTION OF FIGURES

The present invention is illustrated as to a preferred embodiment thereof in the accompanying drawing wherein.

DESCRIPTION OF PREFERRED EMBODIMENT

Figure 5:
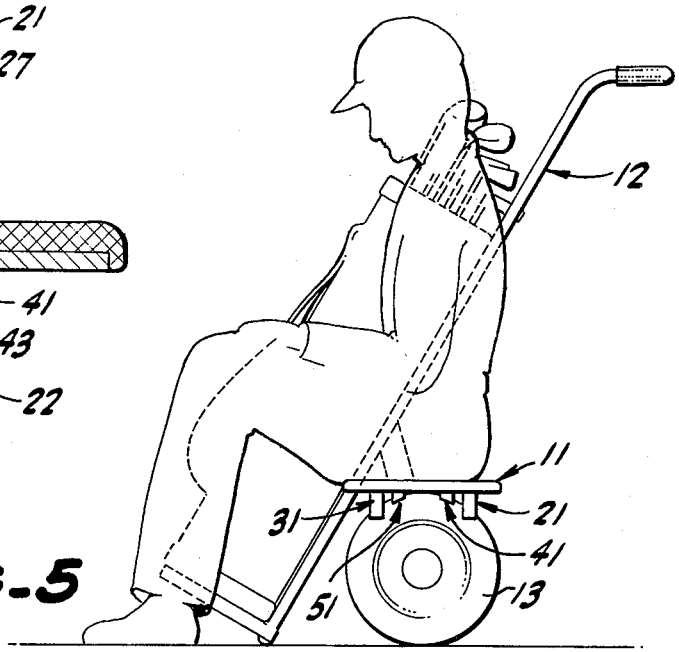
FIG. 5 is a schematic representation of the seat of FIG. 1 in position for use on a tire of a golf cart.

The golf seat of the present invention, as illustrated in the accompanying drawings includes a flat upper seat plate 11 which may be padded, if desired, for accommodating a person sitting upon the seat. The seat plate 11 is adapted to be removeably engaged with the upper surface of a tire on the wheel of the golf cart 12, as generally illustrated in FIG. 5. While various types of seats for this general purpose are known, the present invention is particularly advantageous in providing an improved structure for removeably engaging tires 13 of golf carts.

Referring further to the drawings, there will be seen to be provided a pair of depending mirror-image projections 22 and 22 on the underside of the seat plate 11 spaced equally from opposite sides of a longitudinal center line 23 of the seat plate 11. The projection 21 comprises a generally rectangular lug, or the like, formed integrally with or attached to the underside of the seat plate and having first and second cut-out portions 26 and 27 on the underside thereof with the innermost cut-out portion 26 defining an inclined surface or shoulder slanted toward the longitudinal center of the seat plate from the bottom of the projection 21 upwardly. The outer cut-out portion extends upwardly from the edge of the shoulder 26 and also defines a surface or shoulder 27 inclined upwardly toward the longitudinal center of the seat plate 11. The projection 22 is similarly formed with an inner inclined shoulder 28 and an outer inclined shoulder 29.

Figure 3:
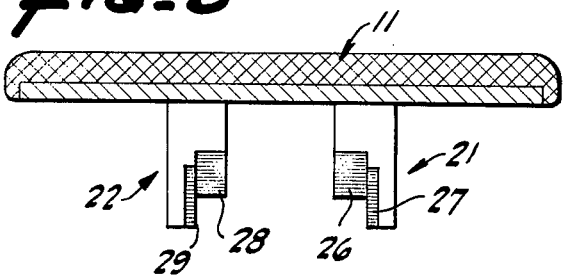
FIG. 3 is a transverse sectional view taken in the plane 3—3 of FIG. 2.

The two shoulders 26 and 28 have the same inclination and, in fact, are aligned with each other on opposite sides of the center line 23, as indicated in FIG. 3 of the drawings, for example, and these shoulders extend from the bottom corner of the projections 21 and 22 upwardly at about a 45° angle to terminate below the middle of the projections. The shoulders 26 and 28 are adapted to engage the periphery of a golf cart tire and the vertical surfaces at the laterally outward edges of these shoulders are spaced apart a distance of $1\frac{1}{2}''$, for example, for engaging a tire having a lateral dimension of $1\frac{1}{2}''$. The shoulders 27 and 29 are also aligned with each other and extended entirely across the projections 21 and 22, respectively, above the lower ends thereof, again as illustrated, for example, in FIG. 3. The outer vertical walls defining the edges of the shoulders 27 and 29 are spaced apart $1\frac{3}{4}''$, for example, so that these shoulders are adapted to rest upon the periphery of a tire having a width of $1\frac{3}{4}''$.

A counterpart of the projections 21 and 22 are provided adjacent the opposite ends of the underside of the seat plate 11 in the form of a pair of projections 31 and 32, which are in fact, identical in shape and placement to the projections 21 and 22, but disposed in facing relationship to the latter. Thus the projection 31 includes an inner inclined surface or shoulder 36 aligned longitudinally of the plate with the shoulder 26 and also inclined upwardly toward the longitudinal center of the plate. The shoulder 36 and a similar facing shoulder 38, on the projection 32, are likewise adapted to rest upon the periphery of a golf cart tire having a width of $1\frac{1}{2}''$, for example, so that the seat will thus be seen to be adapted to rest at four surfaces upon such a tire. Outer shoulders 37 and 39 of the projections 31 and 32 are aligned with the shoulders 27 and 29 of the projections 21 and 22 for also engaging the periphery of a golf cart tire having a lateral width of $1\frac{3}{4}''$, for example. It will be seen that the pairs of projections 21-22 and 31-32 provide for mounting of the seat on golf cart tires of two different widths which generally have about the same diameters.

The present invention provides a further capability of mounting the seat upon golf cart tires of additional sizes and to this end there are provided two additional pairs of projections 41-42 and 51-52, disposed inwardly of the outer projections longitudinally of the seat plate 11. The projections 41-42 are aligned laterally of the seat plate on the underside thereof and spaced equally apart from the longitudinal center line 23 thereof. The lower surfaces 43 and 44 of the projections 41 and 42 are inclined upwardly toward the longitudinal center of the plate and the surface 43 is disposed in part between the shoulders 26-36 and 27-37, as described above, while the surface 44 is disposed in part between the shoulders 28, 38 and 29,39, as shown. Thus a golf cart tire having a width, for example, of 1½" and designed to engage the shoulders 26, 28, 36 and 38 would also be engaged by the under surfaces 43 and 44 of the projections 41 and 42, as well as mirror image surfaces 53 and 54 of the projections 51 and 52. Also a tire having a width of 1¾" would engage these surfaces 43, 44, 53 and 54 as well as the inclined shoulders 27, 38, 29 and 39.

The inner projections 41 and 42 include additional inclined surfaces 45 and 46 inward of the surfaces 43 and 44 and having a separation between the outer walls thereof of 1¼", for example. Mirror image surfaces 55 and 56 of projections 51 and 52, respectively, are aligned with the surfaces 45 and 46, and also are inclined upwardly toward the longitudinal center of the plate so that all four of these surfaces are adapted to engage the periphery of a golf cart tire having a width of 1¼".

Figure 1:
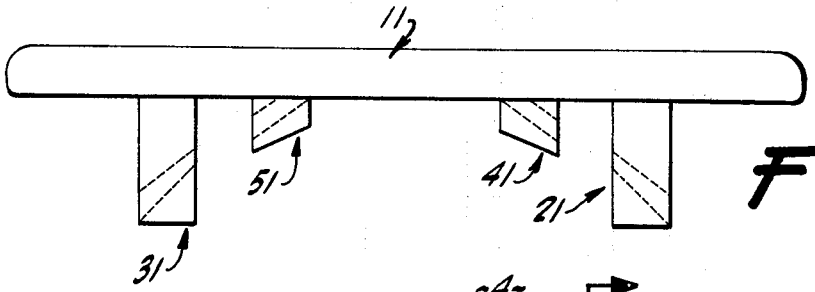
FIG. 1 is a side elevational view of a seat in accordance with the present invention.
Figure 2:
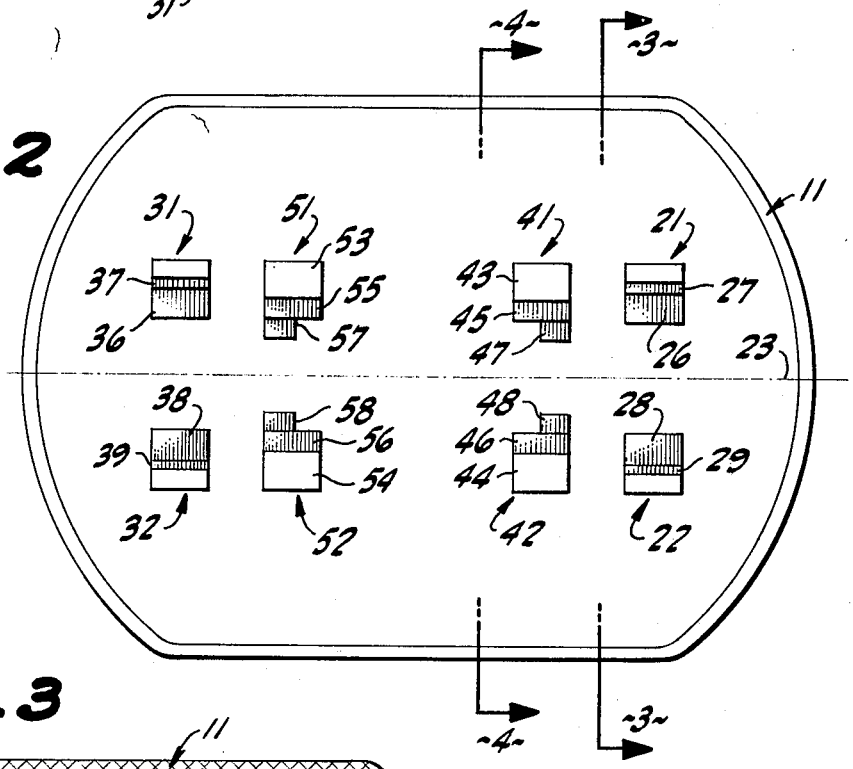
FIG. 2 is a bottom plan view of the seat of FIG. 1.
Figure 4:
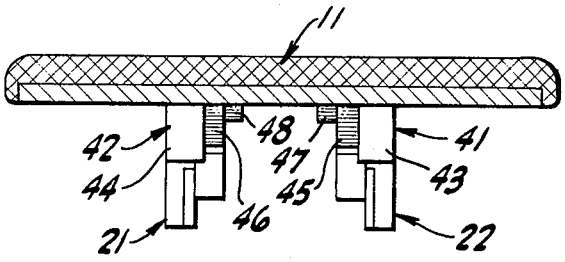
FIG. 4 is a partial transverse sectional view taken in the plane 4—4 of FIG. 2.

A further portion of each of the projections 41 and 42 comprises small inclined shoulders or surfaces 47 and 48 extending only a short distance downwardly from the underside of the plate 11 adjacent the surfaces 45 and 46 of the projections 41 and 42. These surfaces 47 and 48 are inclined upwardly toward the longitudinal center of the plate 11 and have an extent of only about one-half that of the surfaces 45 and 46, as illustrated in FIGS. 2 and 4 of the drawing. The outer upright surfaces adjacent these inclined surfaces or shoulders 47 and 48 may be spaced apart one inch so that these surfaces and the mirror image surfaces 57 and 58 of projections 51 and 52, respectively, are adapted to engage the periphery of a golf cart tire having a one inch width.

It will be seen that the present invention provides means for engaging golf cart tires of varying widths from 1" to 1¾" by uniquely formed and positioned projections on the underside of the seat plate 11. In this manner the utility of the present invention is substantially extended to provide a truly universal golf cart seat firmly fitting substantially all known golf cart tires. The present invention may be readily and inexpensively manufactured with the depending projection unitarily formed with the plate 11. As noted above, separate padding may be provided atop the plate 11 although this is not necessary.

The present invention has been illustrated and described above with respect to a single preferred embodiment thereof, however, it will be apparent to those skilled in the art that modifications and variations may be made within the spirit of the present invention, and thus it is not intended to limit the invention to the details of illustration or precise terms of description.

What is claimed is:

1. A portable seat adapted for removable mounting upon the tire of a golf cart wheel comprising a seat, a rigid plate having an upper surface comprising a seat, a first pair of projections depending from the under side of said plate with each projection having like inner surfaces inclined longitudinally thereon and abutting an outer vertical wall with said walls being spaced apart a predetermined distance substantially equal to the width of a golf cart tire, and a second pair of projections depending from the under side of said plate in spaced relation to said first pair longitudinally of said plate and comprising substantially mirror images of said first pair, with the inclined surfaces of said pairs sloping upwardly toward each other, whereby said projections are adapted to engage a golf cart tire with the inclined surfaces engaging the tire periphery and the walls engaging the sides of the tire to removably mount the seat thereon.

2. The seat of claim 1 further defined by each of said projections having an additional inclined surface abutting another vertical surface with the vertical surfaces of each pair being spaced apart a lesser distance than the walls of the first inclined surfaces and substantially equal to the width of a smaller golf cart tire, whereby said seat is adapted to engage golf cart tires of different sizes for removeable mounting thereon.

3. The seat of claim 2 further defined by a third and a fourth pair of projections depending from the underside of said plate a lesser distance than said first and second pair of projections and having inclined surfaces adjacent vertical walls spaced apart lesser distances than the separation of vertical walls of said first and second projections with the fourth pair being substantially mirror images of said third pair and said third and fourth pair being disposed between said first and second pair, whereby said seat is adapted to engage golf cart tires of lesser width than those fitting said first and second projections for removeable mounting of the seat on narrow golf cart tires.

4. The seat of claim 1 further defined by said first and second pairs of projections having the walls and surfaces thereon aligned longitudinally of said seat and the projections of each pair being disposed on opposite sides of a longitudinal center line of said plate, and all of said inclined surfaces being inclined upwardly toward like surfaces of the other pair of projections.

* * * * *